US010697117B2

(12) United States Patent
Gingras et al.

(10) Patent No.: US 10,697,117 B2
(45) Date of Patent: Jun. 30, 2020

(54) SEGMENTED ROTOR CAP ASSEMBLY

(71) Applicant: ANDRITZ INC., Glens Falls, NY (US)

(72) Inventors: Luc Gingras, Harrogate (GB); Tobias Michel, Werbachhausen (DE)

(73) Assignee: Andritz Inc., Alpharetta, GA (US)

( * ) Notice: Subject to any disclaimer, the term of this patent is extended or adjusted under 35 U.S.C. 154(b) by 1137 days.

(21) Appl. No.: 14/936,524

(22) Filed: Nov. 9, 2015

(65) Prior Publication Data

US 2016/0138220 A1 May 19, 2016

Related U.S. Application Data

(60) Provisional application No. 62/081,818, filed on Nov. 19, 2014.

(51) Int. Cl.
*D21D 1/30* (2006.01)

(52) U.S. Cl.
CPC ..... *D21D 1/306* (2013.01); *D21D 1/30* (2013.01)

(58) Field of Classification Search
CPC ..... D21D 1/30; D21D 1/306; B02C 7/12
USPC ..... 241/261.3, 298
See application file for complete search history.

(56) References Cited

U.S. PATENT DOCUMENTS 161,456 A * 3/1875 Trumbull, Jr. ..... B02C 2/10 241/258
727,156 A * 5/1903 Lacey ..... B02C 7/12 241/246
819,599 A * 5/1906 Robinson ..... D21D 1/306 223/37
827,059 A * 7/1906 Davis ..... B02C 7/12 241/296
1,609,717 A * 12/1926 Holland-Letz ..... D21D 1/306 241/146
2,035,994 A * 3/1936 Sutherland, Jr. ..... B02C 7/12 241/21
2,220,729 A * 11/1940 Powers ..... E03C 1/2665 241/260

(Continued)

FOREIGN PATENT DOCUMENTS

WO 98/37271 8/1998

OTHER PUBLICATIONS

Notification of First Office Action, Chinese Patent Application No. 201510802294.4, dated Mar. 21, 2018, pp. 1-5, Chinese Patent Office, Beijing, China.

(Continued)

*Primary Examiner* — Shelley M Self
*Assistant Examiner* — Smith Oberto Bapthelus
(74) *Attorney, Agent, or Firm* — Robert Joseph Hornung

(57) ABSTRACT

A rotor cap assembly has been conceived using multiple wedge-shaped rotor cap segments, in which the cap segments are disposed on a cap segment retainer and in which the cap segment retainer pilots the multiple rotor cap segments at a diameter intermediate the cap segments' outer diameter and the cap segments' middle diameter. By piloting multiple rotor cap segments with retaining means on the cap segment retainer and positioning means on the multiple cap segments, the rotor cap segments and cap segment retainer assembly may be fixed to a plate holder or directly to a rotor disc of a refiner without substantially altering either the plate holder or the rotor disc.

24 Claims, 11 Drawing Sheets

(56) References Cited

U.S. PATENT DOCUMENTS 3,125,306 A * 3/1964 Kollberg ..... D21D 1/306 241/298
3,473,745 A * 10/1969 Soars, Jr. ..... B02C 7/12 241/298
4,166,584 A * 9/1979 Asplund ..... D21D 1/30 241/261.3
4,469,284 A * 9/1984 Brubaker ..... B02C 2/10 241/257.1
5,203,514 A * 4/1993 Mokvist ..... B02C 7/11 241/261.3
5,383,617 A * 1/1995 Deuchars ..... B02C 7/12 241/261.2
5,875,982 A * 3/1999 Underberg ..... D21D 1/30 241/261.3
5,971,307 A * 10/1999 Davenport ..... B02C 7/04 241/259.1
6,024,308 A * 2/2000 Bartels ..... B02C 7/12 241/261.3
6,227,471 B1 * 5/2001 Virving ..... B02C 7/11 241/244
6,616,078 B1 * 9/2003 Gingras ..... B02C 7/12 241/261.2
6,932,290 B2 * 8/2005 Virving ..... B02C 7/12 241/298
6,957,785 B2 * 10/2005 Virving ..... B02C 7/12 241/166
7,191,967 B2 * 3/2007 Vuorio ..... B02C 7/12 241/261.3
8,028,945 B2 * 10/2011 Gingras ..... D21D 1/30 241/245
8,061,443 B2 11/2011 Gingras
8,061,643 B2 * 11/2011 Gingras ..... D21D 1/30 241/261.2
8,573,521 B2 * 11/2013 Gingras ..... D21D 1/30 241/28
8,671,546 B2 3/2014 Gingras
9,708,765 B2 * 7/2017 Gingras ..... D21D 1/306
9,968,938 B2 * 5/2018 Gingras ..... D21D 1/306
2006/0175447 A1 * 8/2006 Duggan ..... B02C 7/06 241/261.2
2008/0296419 A1 * 12/2008 Gingras ..... D21D 1/30 241/28
2012/0018549 A1 * 1/2012 Gingras ..... D21D 1/30 241/24.29
2013/0015281 A1 * 1/2013 Gingras ..... D21D 1/306 241/296
2013/0270377 A1 * 10/2013 Gingras ..... D21B 1/26 241/220
2014/0077016 A1 * 3/2014 Gingras ..... D21D 1/306 241/298
2014/0110511 A1 * 4/2014 Antensteiner ..... D21D 1/303 241/28
2014/0131489 A1 * 5/2014 Gingras ..... B02C 7/12 241/28
2014/0246530 A1 * 9/2014 Ahlgren ..... B02C 7/11 241/246
2016/0138220 A1 * 5/2016 Gingras ..... D21D 1/306 241/298
2017/0275819 A1 * 9/2017 Gingras ..... D21D 1/306

OTHER PUBLICATIONS

Maisonnier, Claire, Extended European Search Report, dated Mar. 21, 2016, pp. 1-7, European Patent Office, Munich, Germany.

* cited by examiner

SEGMENTED ROTOR CAP ASSEMBLY

CROSS-RELATED APPLICATION

This Application is a non-provisional application claiming the benefits of U.S. provisional patent application Ser. No. 62/081,818 filed Nov. 19, 2014, the entirety of which is incorporated herein by reference.

BACKGROUND OF THE INVENTION

1. Technical Field

This disclosure relates generally to refiners configured to process lignocellulosic material, and more particularly to rotor caps within refiners.

2. Related Art

Mechanical pulping, dispersion, and medium density fiberboard ("MDF") processes involve mechanical treatment of lignocellulosic material between rotating discs or cones. Throughout this application, "refiner" will be understood to refer mechanical refiners, dispersers, or other devices configured to separate, develop, and cut fibers in lignocellulosic material with refiner plates having abrasive surfaces.

Refiners can be broadly categorized into disc refiners and conical refiners. Disc refiners include the single-disc refiner, the double-disc, and the twin refiner. The double-disc refiner is also known as a "counter-rotating refiner." The single-disc refiner generally has one rotor disc placed opposite a stationary stator disc. The double-disc refiner generally has two opposing discs that rotate in opposite directions. The twin refiner typically utilizes a rotating double-sided disc disposed between two stationary discs. Conical refiners use nested truncated cones to develop, separate, and cut lignocellulosic material. Some conical refiners comprise a flat refining area, followed by a conical refining area, while some conical refiners comprise only a conical section such that lignocellulosic material development, separation, and cutting occurs substantially entirely in the conical section.

Refiners typically have refiner plates mounted on two or more discs or cones. The refiner plates usually have an abrasive surface comprising a pattern of bars and grooves, a pattern of intermeshing teeth, or a combination thereof. A refiner plate's abrasive surface is generally adapted to process wood fibers or other lignocellulosic material to form pulp. A refining gap separates oppositely disposed abrasive surfaces on oppositely disposed discs or cones. In a mechanical pulp refiner, the refining gap typically has a width of less than one millimeter ("mm"). In mechanical dispersers, the width of the refining gap may range from 1 mm to about 6 mm.

Disc refiners generally have a feed inlet at the center of one of the opposing discs. In single disc refiners, the feed inlet typically extends through the center of the stator. During operation, the rotor spins quickly, generally in a range of 1,200 to 1,800 rotations per minute ("rpm"). Operators inject lignocellulosic feed material through the feed inlet and the lignocellulosic feed material quickly contacts a rotor cap at the center of the spinning rotor. As the lignocellulosic feed material contacts the rotor cap, wide bars on the rotor cap fling the lignocellulosic feed material into the refining gap. As such, the rotor cap is also known as a "flinger".

The high centrifugal forces along the radial length of the rotor, force lignocellulosic material through the refining gap and thereby allow the refiner plates' abrasive surfaces to separate, develop, and cut the lignocellulosic fibers. This separation, development, and cutting of the lignocellulosic fibers can generate steam, which may contribute to abrasive surface erosion over time. After a single pass through the refiner, the lignocellulosic material generally exits the refining gap at the outer diameter of the refiner plates. Once expelled from the refining gap, the lignocellulosic material may be collected for further processing, which may include additional refining passes.

Over time, prolonged exposure to lignocellulosic feed material grinds away the rotor cap's wide bars. Contaminants in the lignocellulosic material such as sand, stones, and pieces of concrete, dirt, metal fragments, and other coarse biological material, can also accelerate rotor cap wear. Large contaminants, such as metal pieces or concrete can sheer off chunks of rotor cap and wear the rotor cap asymmetrically. Rotor cap wear, particularly uneven wear, can disrupt the rate at which lignocellulosic material enters the refining gap, which can ultimately destabilize the refiner, reduce refining capacity, and decrease fiber quality.

To avoid these problems, operators generally schedule maintenance periods to deactivate mechanical pulp refiners and evaluate wear. If the rotor cap has deteriorated sufficiently, an operator may prescribe replacement. Downtime varies depending on the type of refiner, but downtime generally ranges from three to twelve hours, and may require several workers and heavy equipment to handle worn rotor caps.

Rotor caps are commonly cast in steel or other durable material. Rotor caps may vary in weight. Large rotor caps may weigh over 100 kilograms ("Kg"). Operators typically utilize overhead cranes, forklifts, or similar heavy equipment when replacing a rotor cap for all but the lightest rotor caps. Heavy equipment increases maintenance time, costs, and risk of injury to personnel.

A rotor cap that is positioned so that the rotor cap's mass is evenly distributed around the rotor's center of rotation and that experiences uniform centripetal force during rotor operation is known as a "piloted" rotor cap. If a rotor cap is improperly piloted, the rotor cap's uneven weight distribution and unbalanced physical forces could create vibrations and accelerate rotor shaft wear. Improper piloting may also increase the risk that the oppositely disposed refiner plates will contact each other during operation, thereby predicating violent refiner plate destabilization, potential harm to personnel, and damage to surrounding equipment.

The time required to pilot a replacement rotor cap, together with the temporal and financial costs associated with maintenance periods contributes to production loss. As a result, operators may delay rotor cap replacement and extend rotor cap use beyond the rotor cap's useful life. Delayed maintenance can lead to inefficient mechanical refiner performance (e.g. from uneven rotor cap wear), which can pose safety risks, increase energy consumption, and negatively impact fiber quality.

As such, there is a long felt need to reduce maintenance time for the removal and replacement of worn rotor caps while improving safety conditions for operating personnel.

BRIEF SUMMARY OF THE INVENTION

The problems of personnel safety risks and loss of production attributable to conventional refiner rotor caps is mitigated by using a segmented rotor cap assembly that comprises a cap segment retainer positioned behind rotor cap segments, wherein each rotor cap segment is configured to be retained by the cap segment retainer, wherein the cap segment retainer can be piloted around the rotor's center of rotation, and wherein the cap segment retainer has retaining means configured to pilot a rotor cap segment at a diameter intermediate the cap segment's inner diameter and outer diameter or at the rotor cap segment's outer diameter.

The present disclosure utilizes a segmented rotor cap assembly configured to position rotor cap segments such that the rotor cap segments resist the centrifugal force of a spinning rotor (i.e. the inertia the mass of the rotor experiences as a result of circular motion). High consistency refiners generally have rotors that can operate at 1,200 to 1,800 rpm and the segmented rotor cap assembly is desirably configured to withstand corresponding high inertia that results from the rotor's circular motion. In traditional single-piece rotor cap designs, this inertia is generally of minimal concern if the traditional rotor cap is adequately piloted at the rotor's center by a pin. If a traditional single-piece rotor cap is made of steel or another similar material commonly used in the industry, the structural integrity of the material generally provides sufficient centripetal force to cancel out the centrifugal forces of an operational rotor. That is, if the single-piece rotor cap's mass is evenly distributed around the rotor's center of rotation, the centrifugal and centripetal forces cancel out, thereby balancing the single-piece rotor cap.

Exemplary rotor cap segments typically have a shape of a geometric annulus sector and have an annularly truncated lower portion, such that the annular sector does not terminate in a pointed wedge. When operators attach multiple refiner plate segments directly or indirectly to the rotor and adjacently to other rotor cap segments, the multiple rotor cap segments typically form an annulus. In other exemplary embodiments, the segmented rotor cap assembly may further comprise a central cap segment disposed on the center of the cap segment retainer. In other exemplary embodiments, multiple central cap segments may be provided. Exemplary rotor cap segments, including central cap segments, and the cap segment retainer may be made of stainless steel or other materials configured to withstand frequent contact with the abrasive lignocellulosic feed material and corrosive steam.

Segmenting an otherwise single-piece rotor cap obviates the structural integrity of the single-piece rotor cap, creates multiple centers of gravity, and unbalances the rotor cap system. Despite this fact, Applicant decided to segment the rotor cap and; rather than attempt to pilot the rotor cap segments at the center of rotation, to instead provide piloting means at an intermediate diameter of the rotor cap segments. In other exemplary embodiments the rotor cap segments may be piloted at the rotor cap segment's outer diameter. If rotor cap segments are improperly piloted, the inertia caused by the rotor's rotational motion may cause the rotor cap segments to move radially outward from rotor's center of rotation, which may cause vibrations, cause a rotor cap segment to enter the refining gap, or otherwise interrupt the refiner's functionality.

To address this issue, Applicant has provided a segmented rotor cap assembly, which comprises a cap segment retainer that may desirably be piloted around the rotor. The cap segment retainer is generally circular or annular. The front of the cap segment retainer may have retaining means configured to engage positioning means on the back of rotor cap segments, particularly during the rotor's circular movement. In this manner, the cap segment retainer may position and provide centripetal forces sufficient to balance the inertia the rotor cap segments experienced during the rotor's circular movement and thereby pilot the rotor cap segments.

In an exemplary embodiment, the cap segment retainer may have retaining means configured to pilot a rotor cap segment at the rotor cap segment's outer diameter. In another exemplary embodiment, the cap segment retainer may have retaining means configured to pilot a rotor cap segment at a diameter intermediate the rotor cap segment's outer diameter and middle diameter. In still other exemplary embodiments, the cap segment retainer may have retaining means configured to pilot a rotor cap segment at a diameter intermediate the rotor cap segment's middle diameter and inner diameter.

The retaining means may be retaining lips, steps, protrusions, clamps, pins, teeth, or other similar retaining means configured to pilot the cap segments. In embodiments where the retaining means are retaining lips, the positioning means may be positioning lips configured to position the a rotor cap assembly in a concave space defined by one or more retaining lips and to engage the retaining lips during the rotor's circular motion. In this manner, the retaining lips and the positioning lips position the rotor cap segment on the rotor cap retainer and provide centripetal force configured to cancel out the inertia the rotor cap segments experience as a result of the rotor's circular motion to thereby pilot the rotor cap segments. In embodiments where the retaining means are retaining steps, the positioning means may be positioning steps configured to engage the retaining steps. In embodiments where the retaining means are clamps, the positioning means may be one or more protrusions configured to interlock with the clamps. In embodiments where the positioning means are pins, the retaining means may be a hole configured to receive the pin. In embodiments where the retaining means are teeth, the positioning means may be indentations configured to engage and interlock with the teeth. In embodiments where the retaining means are other retaining means configured to pilot the cap segments, the positioning means may be other positioning means configured to engage the retaining means whereby the retaining means provide centripetal force sufficient to cancel out the inertia of the rotor cap segment caused by the rotor's circular motion and whereby the retaining means and the positioning means position the rotor cap segment on the cap segment retainer during the rotor's circular motion.

It will be understood that in embodiments where lips, steps, clamps, pins, teeth or similar interlocking mechanisms are disposed on rotor cap segments, the retaining means on the cap segment retainer may be configured to interlock with the interlocking mechanisms on the rotor cap segments and vice versa. It will further be understood that lips, steps, clamps, pins, teeth, or similar interlocking mechanisms may be used singularly or in combination with the interlocking mechanisms disclosed herein. Further, in other exemplary embodiments, the interlocking elements that comprise the interlocking mechanisms (e.g. clamps and one or more protrusions configured to interlock with the clamps) may be disposed on a rotor cap segment, a central cap segment, the cap segment retainer, or a combination thereof. An interlocking element of an interlocking mechanism disposed on a cap segment is known as a "cap segment interlocking element," an interlocking element of an interlocking mechanism disposed on a cap segment retainer is known as a "retainer interlocking element," and an interlocking element disposed on a central cap segment is known as a "central cap segment interlocking element." It will further be understood that interlocking mechanisms, in addition to retaining means configured to be used with positioning means, may be referred to as "piloting means" throughout this disclosure.

If the retaining means are retaining lips, the retaining lips may have a height of 5 mm to 15 mm. The retaining lips are generally configured such that the height of the retaining lip is sufficiently tall to engage the height of the sidewall of a positioning protrusion extending from the back of the rotor cap segment. The retaining lips are desirably configured to engage the sidewall of a protrusion extending from the back of the rotor cap segment such that each retaining lip is substantially flush to each sidewall of a protrusion extending from the back of the rotor cap segment.

By providing piloting means configured to pilot the rotor cap segments at a diameter intermediate the rotor cap segments' inner diameter and the rotor cap segments' outer diameter, or by providing piloting means configured to pilot the rotor cap segments at the rotor cap segments' outer diameter, Applicant has found that it is possible to use rotor cap segments in lieu of single-piece rotor caps.

Additionally, Applicant has found that wide bars and channels approaching the rotor cap's outer diameter tend to wear at a greater rate than wide bars and channels nearer the center of rotation. It is therefore an object of the present disclosure to permit localized replacement for worn wide bars near the outer periphery of a rotor cap assembly, while permitting serviceable wide bars and channels closer to the center of rotation to remain in use.

It is an object of the present disclosure to have rotor cap segments configured to be removed and replaced after a desired time period, such as bi-annually, to ensure suitable refiner operating performance and hence preserve fiber quality.

It is another object of the present disclosure to permit manual installation of rotor cap segments onto a cap segment retainer, without the need for using an overhead crane.

It is a further object of the present disclosure to reduce refiner downtime during maintenance periods.

It is a still further object of the present disclosure to provide a cap segment retainer configured to provide centripetal force to rotor cap segments engaged with the cap segment retainer.

In an exemplary embodiment of the rotor cap assembly, the rotor cap may comprise cap segments disposed adjacently to a cap segment retainer. The cap segment retainer may be mounted to a rotor in a refiner. The cap segment retainer may have a back side that may be disposed on the rotor, and the cap segment retainer may have a front side that is adjacent to the cap segments such that the cap segment retainer is disposed between the cap segments and the rotor. In still other exemplary embodiments, the cap segment retainer may be annular such that the cap segment retainer defines a hole in the center of the cap segment retainer. In embodiments comprising an annular cap segment retainer, a rotor central part (e.g. a hub) may be attached directly to the rotor and the rotor central part may extend through the hole in the center of the annular cap segment retainer. In such embodiments comprising an annular cap segment retainer, there is generally no central cap segment or central portion of the cap segment retainer. The cap segment retainer may have piloting means for the cap segments.

A rotor cap assembly in accordance with the present disclosure may be used in conjunction with each of either disc refiners or conical refiners. With regard to conical refiners, the cap segment retainer and cap segments may be substantially similar to cap segment retainers used in conjunction with disc refiners.

In another exemplary embodiment, the cap segment retainer may further comprise a first retaining means configured to pilot a rotor cap segment at a first intermediate diameter on the rotor cap segment and a second retaining means configured to pilot a rotor cap segment at a second intermediate diameter on the rotor cap segment radially distal from the first intermediate diameter. In certain exemplary embodiments, the second retaining means may be at a rotor cap segment outer diameter. The first retaining means can engage a first positioning means on the rotor cap segment's first intermediate diameter and the second retaining means can engage a second positioning means on the rotor cap segment's second intermediate diameter. In other exemplary embodiments, the first intermediate diameter may be disposed on an inner rotor cap segment while the second intermediate diameter may be disposed on an outer rotor cap segment. In exemplary embodiments involving an inner rotor cap segment and an outer rotor cap segment, the first diameter may be at the inner rotor cap's outer diameter. The second diameter may be at the rotor cap's outer diameter. In other exemplary embodiments, more than two sets of rotor cap segments may be disposed radially on the rotor. Combinations of the above are considered to be within the scope of this disclosure.

The retaining means may be circumferential. In certain exemplary embodiments, a series of retaining means may be configured to engage a rotor cap segment at a rotor cap segment outer diameter or rotor cap segment intermediate diameter. A series of positioning means on the rotor cap segments may be configured to engage the retaining means. In other exemplary embodiments, the retaining means may be circumferential, continuous, and disposed on a cap segment retainer at the cap segment retainer's outer diameter, a cap segment retainer intermediate diameter, or a combination thereof. The retaining means on the cap segment retainer may be disposed between about 10 mm from the center of rotation of the rotor (e.g. the rotational axis) to about 25 mm from the center of rotation of the rotor. In other exemplary embodiments, the retaining means may be disposed between about 10 mm from the rotor cap segment's outer diameter to about 25 mm from the rotor cap segment's outer diameter. The distance from the center of rotation of the rotor to the retaining means is commonly known as the radial length. The retaining means may desirably have a radial length of 12 mm.

An exemplary method for replacing a segmented rotor cap may comprise deactivating an active refiner, accessing the rotor, disengaging a rotor cap from a rotor, positioning a cap segment retainer over a center of the rotor, positioning a cap segment over the cap segment retainer, securing the cap segment retainer on the center of the rotor by using fasteners extending from the rotor cap segments through the cap segment retainer, and into the rotor, wherein the cap segment retainer has a front side and retaining means disposed on the front side of the cap segment retainer, wherein the rotor cap segments have a back side and positioning means disposed circumferentially at a diameter on the back side, and wherein the positioning means of the rotor cap segments engage the retaining means of the cap segment retainer. In other exemplary embodiments, the fasteners may extend from the rotor through the cap segment retainer and into the rotor cap segments.

In another exemplary method, the cap segment retainer may be positioned over a center of a plate holder. The cap segment retainer may be secured into position by fasteners extending from rotor cap segments through the cap segment retainer and into the plate holder. In other exemplary embodiments, the fasteners may extend from the plate holder through the cap segment retainer and into the rotor cap segments.

BRIEF DESCRIPTION OF THE DRAWINGS

The foregoing will be apparent from the following more particular description of exemplary embodiments of the disclosure, as illustrated in the accompanying drawings. The drawings are not necessarily to scale, with emphasis instead being placed upon illustrating the disclosed embodiments.

DETAILED DESCRIPTION OF THE PREFERRED EMBODIMENTS

Figure 1A:
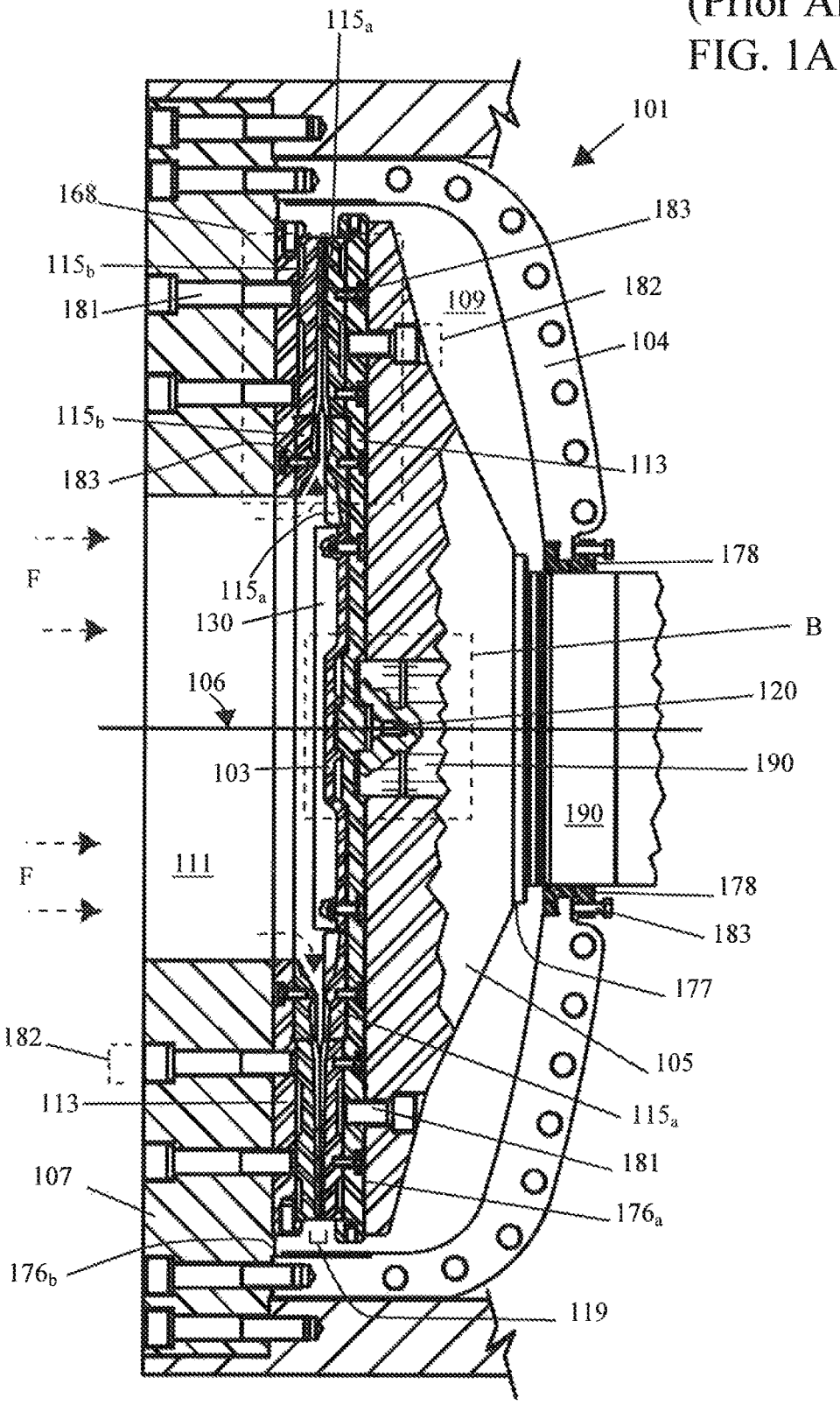
(Prior Art) FIG. 1A
FIG. 1A is a cross-section of a single disc refiner with a conventional single-piece rotor cap, a rotor plate holder, and a stator plate holder.

The following detailed description of the preferred embodiments is presented only for illustrative and descriptive purposes and is not intended to be exhaustive or to limit the scope and spirit of the invention. The embodiments were selected and described to best explain the principles of the invention and its practical application. A person of ordinary skill in the art will recognize many variations can be made to the invention disclosed in this specification without departing from the scope and spirit of the invention. Except as otherwise stated, corresponding reference characters indicate corresponding parts throughout the several views. Although the drawings represent embodiments of various features and components according to the present disclosure, the drawings are not necessarily to scale and certain features may be exaggerated in order to better illustrate embodiments of the present disclosure, and such exemplifications are not to be construed as limiting the scope of the present disclosure in any manner.

FIG. 1A is a cross-section of a conventional single-disc refiner 101 having a housing 104 defining a chamber 109. A rotor 105 resides within the chamber 109. The rotor 105 has a plate side $\mathbf{176}_a$ and a rotor shaft side 177. The rotor shaft side 177 engages a rotor shaft 190 that extends through a seal 178 disposed within the housing 104. Fasteners 183 may engage the seal 178 to the housing 104. The seal 178 isolates the temperature and pressure within the chamber 109 from the external environment. A motor (not depicted) engages the rotor shaft 190 and drives the rotor shaft 190 and rotor 105 around the center of rotation 106.

A stator 107 is disposed opposite the rotor 105. The stator 107 has a plate side $\mathbf{176}_b$ opposite the plate side $\mathbf{176}_a$ of the rotor 105. Bolts 181 engage a plate holder 113 to the plate side $\mathbf{176}_b$ of the stator 107 through fixing holes 182 in the stator 107. These bolts 181 similarly engage the plate holder 113 to the plate side $\mathbf{176}_a$ of the rotor 105 through fixing holes 182 in the rotor 105. The bolts 181 may extend through the stator 107. The bolts 181 may extend through the rotor 105. Fasteners 183 can extend to the plate holder 113 to engage refiner plate segments $\mathbf{115}_b$ on the stator 107. Similarly, fasteners 183 can extend through the plate holder 113 to hold the refiner plate segments $\mathbf{115}_a$ on the rotor 105. The plate holders 113 may provide additional fastener holes that do not communicate with the rotor 105. This allows operators to assemble the refiner plate segments $\mathbf{115}_a$, $\mathbf{115}_b$ on the single piece plate holder before installing the plate holder 113 to the rotor 105.

Refiner plate segments 115 usually have an abrasive surface comprising a pattern of bars and grooves (see FIG. 4), a pattern of intermeshing teeth, or a combination thereof. The refiner plate segments $\mathbf{115}_a$ on the rotor 105 do not contact the refiner plate segments $\mathbf{115}_b$ on the stator 107; rather, a refining gap 119 exists between the opposing sets of refiner plate segments $\mathbf{115}_a$ and $\mathbf{115}_b$.

In the depicted single disc refiner, the stator 107 further defines a feed inlet 111 disposed opposite the single-piece rotor cap 103. As the rotor 105 spins, operators feed lignocellulosic feed material F through the feed inlet 111. Wide bars 130 may be disposed upon the single-piece rotor cap 103. As the lignocellulosic material F contacts the spinning single-piece rotor cap 103 or wide bars 130, the single-piece rotor cap 103 or wide bars 130 flings the lignocellulosic feed material F through the refining gap 119 in the refining area 168 (see path depicted by arrows in FIG. 1). As lignocellulosic fibers, steam, and debris flow through the refining gap 119, the abrasive surfaces on the refiner plate segments 115 generally separate, develop, and cut lignocellulosic fibers into desirable lengths and properties. After passing though the refining gap 119, operators may collect the refined lignocellulosic fibers for further processing, which may include additional refiner passes.

Figure 1B:
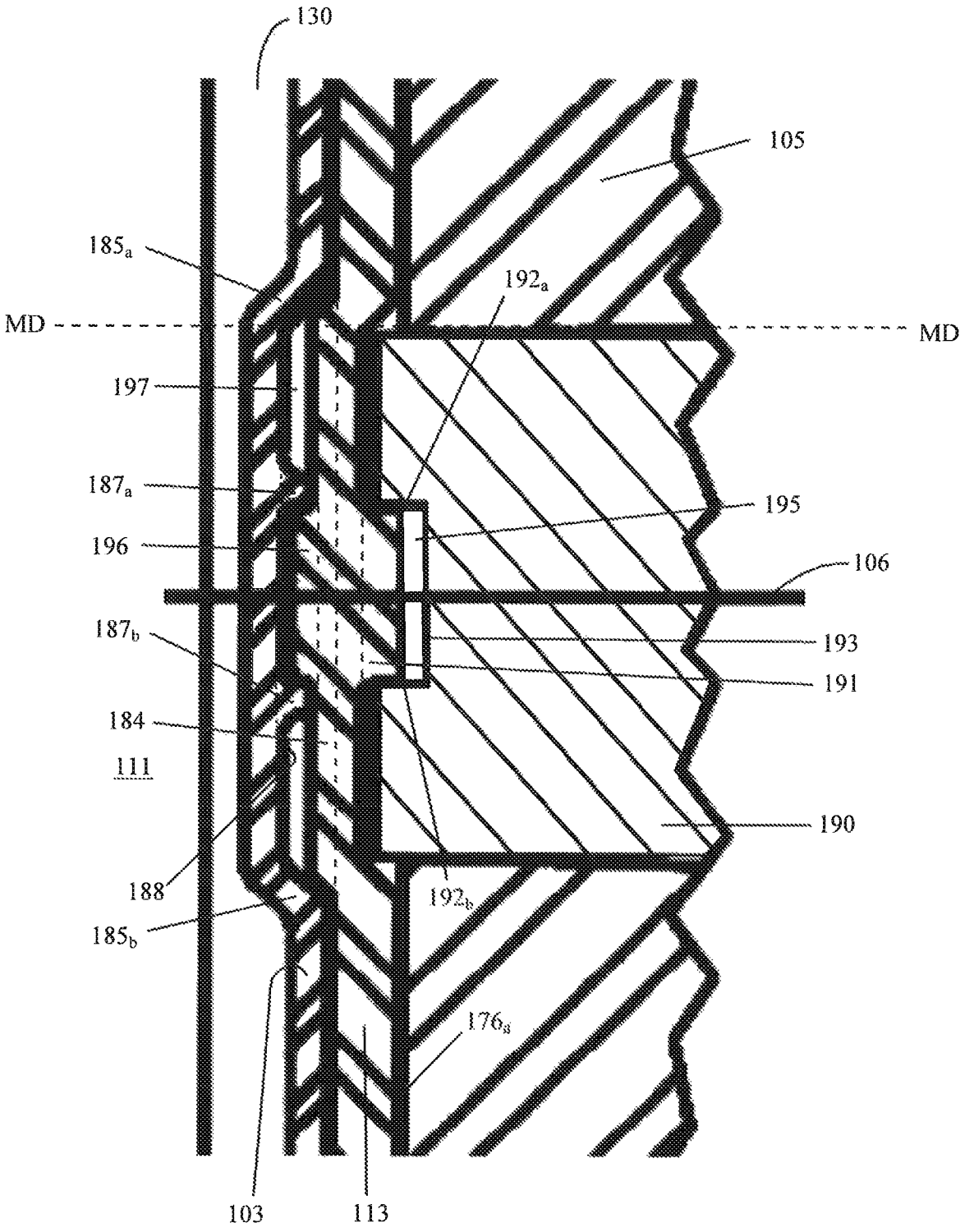
(Prior Art) FIG. 1B
FIG. 1B is an expanded view of the single disc refiner of FIG. 1A, which further depicts piloting the single-piece rotor cap around the center of rotation.

FIG. 1B is a detailed view of the box B depicted in FIG. 1A. The rotor 105 may have a rotor shaft 190 having a weight evenly distributed around the center of rotation 106. The rotor shaft 190 has sides $\mathbf{192}_a$, $\mathbf{192}_b$ extending outwardly from a core bottom 193 that define a concave space 195 at the plate side $\mathbf{176}_a$ of the rotor 105. The concave space 195 is disposed around the center of rotation 106. A first block 191 of the plate holder 113 extends into the concave space 195. In so doing, the first block 191 pilots the plate holder 113 at the rotor's center of rotation 106. That is, the sides $\mathbf{192}_a$, $\mathbf{192}_b$ of the rotor shaft 190 pilot the plate holder 113 to the rotor 105 so that the plate holder 113 rotates around the plate holder's center of gravity.

In FIG. 1B, the plate holder 113 further has a second block 196 extending into a concave space 197 defined by steps $187_a$, $187_b$ extending from the back side 188 of the single-piece rotor cap 103. The steps $187_a$, $187_b$ position the single-piece rotor cap 103 around the center of rotation 106 and the structural integrity of the single-piece rotor cap 103 provides the centripetal force that balances the inertia that the single-piece rotor cap 103 experiences as a result of the rotor's circular motion. The single-piece rotor cap 103 may be further positioned at a middle diameter (MD) by slanted walls $185_a$, $185_b$ engaging a third block 184 of the plate holder 113.

Figure 2A:
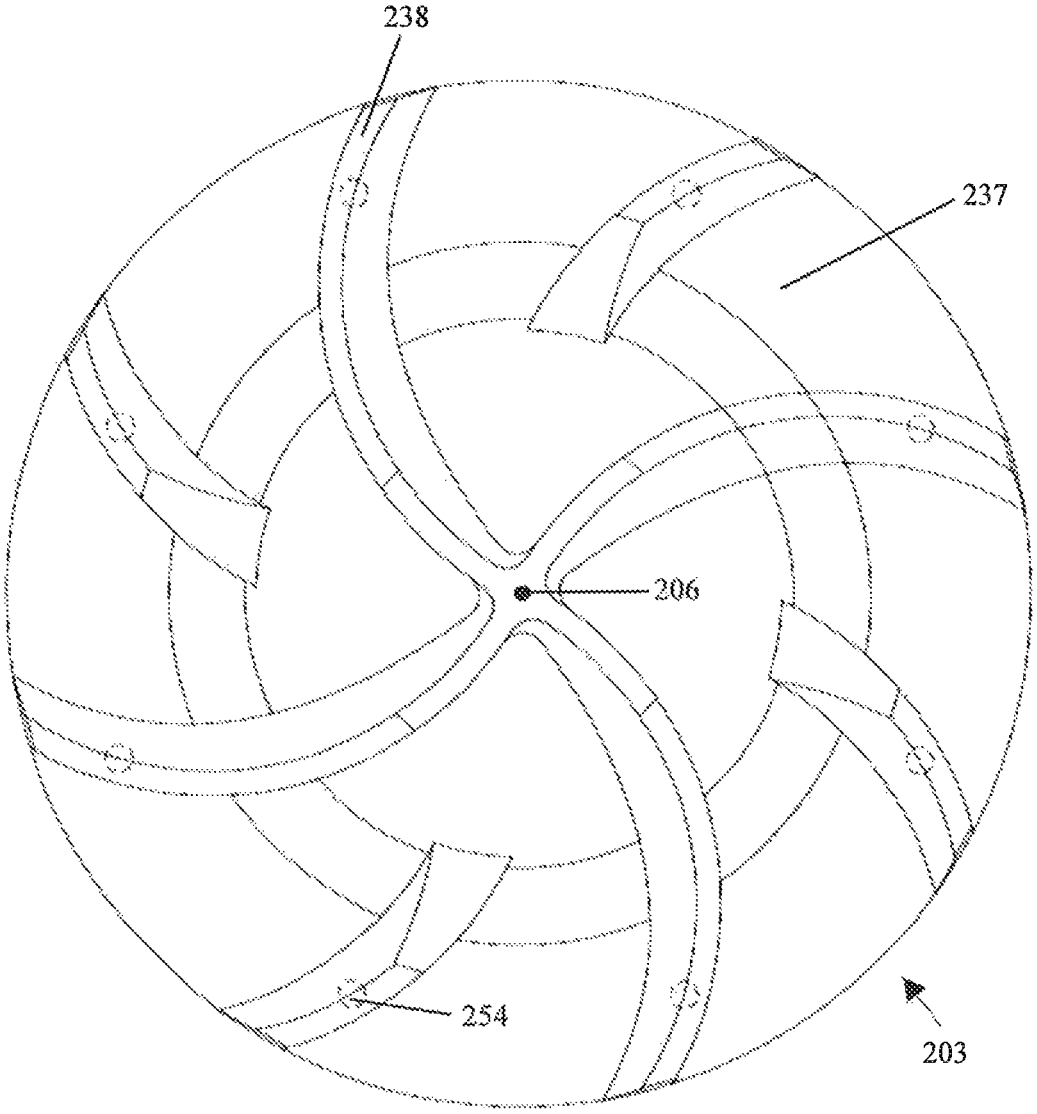
(Prior Art) FIG. 2A
FIG. 2A is a facing view of a conventional single-piece rotor cap.

FIG. 2A is a front view of a conventional single-piece rotor cap 203. The single-piece rotor cap may weigh between 80 lbs. and 200 lbs. and is generally piloted around the center of rotation 206, which generally coincides with the single-piece rotor cap's center of gravity. The single-piece rotor cap's weight can encourage operators to use cranes, forklifts, or other heavy equipment when replacing worn rotor caps 203. The single-piece rotor cap 203 has wide bars 238 and wide channels 237 configured to direct lignocellulosic feed material F (FIG. 1A) into the refining gap 119 (FIG. 1A). In this version, the single-piece rotor cap 203 is fixed to the plate holder 113 (FIG. 1A) from the back through fasteners 183 extending through threaded holes 250. Single-piece rotor caps 203 have threaded holes 250 towards the periphery and lack such holes at smaller diameters.

Figure 2B:
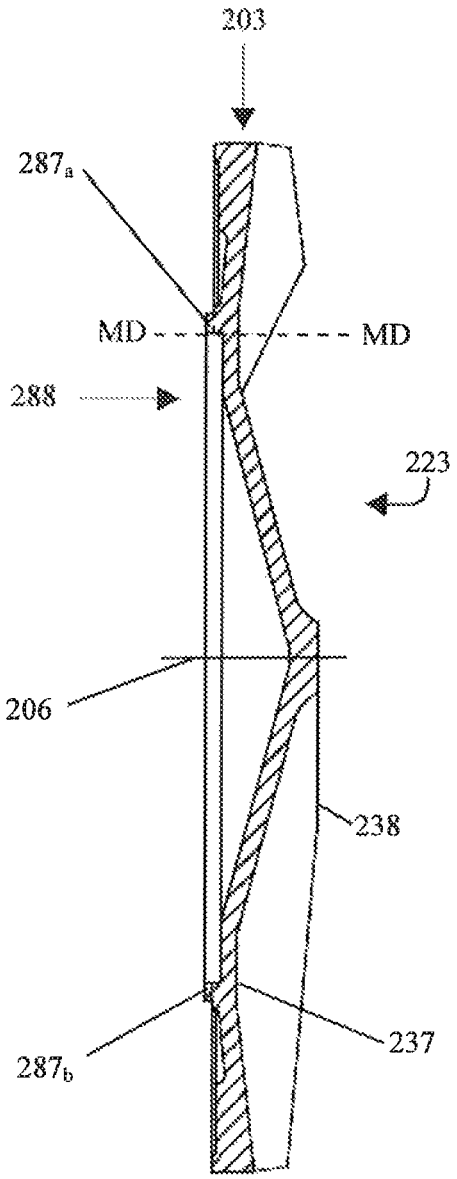
(Prior Art) FIG. 2B
FIG. 2B is a cross-sectional side view of a conventional single-piece rotor cap.

FIG. 2B is a cross-sectional side view of a traditional single-piece rotor cap 203. The single-piece rotor cap 203 has a front side 223 and a back side 288. The single-piece rotor cap 203 may have steps $287_a$, $287_b$ extending from the back 288 side of the single-piece rotor cap 203 at the middle diameter MD. The steps $287_a$, $287_b$ pilot the single-piece rotor cap 203 so that the single piece rotor cap 203 is centered on the rotor 205. As the single-piece rotor cap 203 rotates, the wide bars 238 and wide channels 237 direct lignocellulosic material F into the refining gap 119.

Figure 3A:
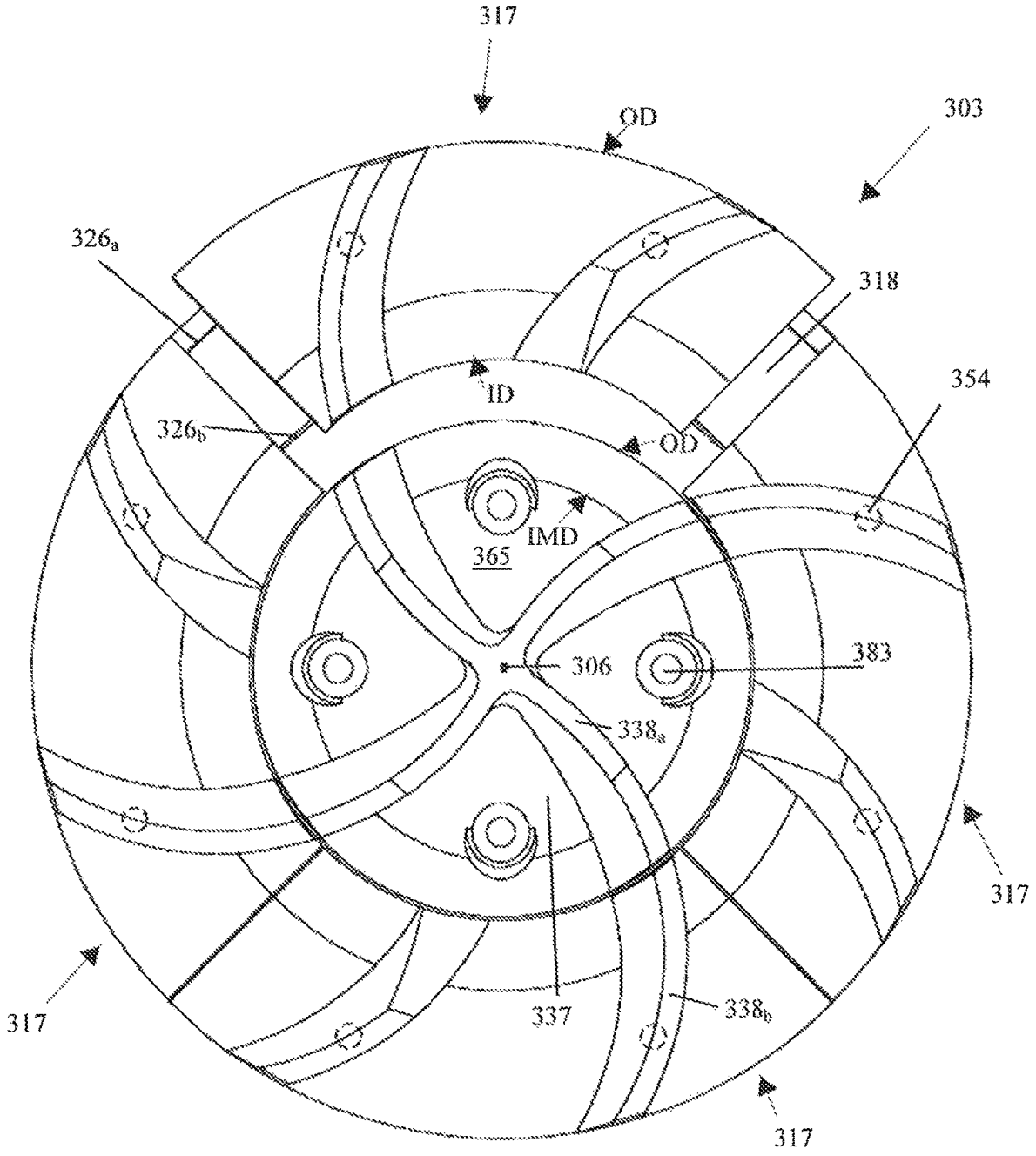
FIG. 3A is a facing view of an exemplary embodiment of the segmented rotor cap assembly.

FIG. 3A depicts a front view of an exemplary embodiment of a segmented rotor cap assembly 303. A central cap segment 365 is disposed around the center of rotation 306. In an exemplary embodiment, the central cap segment 365 may be piloted at an intermediate diameter IMD. The central cap segment's intermediate diameter IMD may be disposed between the center of rotation 306 and the central cap segment's outer diameter OD. The central cap segment's outer diameter OD may be disposed adjacent to a rotor cap segment's inner diameter ID. In other exemplary embodiments, the central cap segment 365 may be absent and the cap segment retainer 318 may be configured to have a center portion 365' exposed to the lignocellulosic feed material F while providing retaining means for rotor cap segments 317 (see FIG. 3C).

In FIG. 3A, fasteners 383 extend through the central cap segment 365 and terminate in the cap segment retainer 318 to engage the central cap segment 365 to the cap segment retainer 318. Fasteners 383 extending through separate holes (354, see FIG. 3B) may engage the cap segment retainer 318 to pre-existing fixing holes in the rotor 105 or holes in the plate holder 113. The central cap segment 365 may have wide channels 337 defined by adjacent wide bars $338_a$ on the front side 323 of the segmented rotor cap assembly 303. One or more of the wide bars $338_a$ on the central cap segment 365 may align radially with one or more wide bars $338_b$ on the rotor cap segments 317 such that the radially aligned wide bars $338_a$, $328_b$ appear to extend from a point (see 306) on the central cap segment 365. In other exemplary embodiments, the wide bars $338_a$ on the central cap segment 365 may not align radially with one or more wide bars $338_b$ on the rotor cap segments 317.

The rotor cap segments 317 are disposed radially outward from the center of rotation 306 around the central cap segment 365 or central cap portion 365'. The rotor cap segments 317 are generally configured to be regular segments of a geometric annulus. In other exemplary embodiments, fasteners 383 may extend through the rotor cap segments 317, cap segment retainer 318, and through pre-existing holes in the rotor 105 to sandwich the cap segment retainer 318 between the rotor cap segments 317 and the rotor 105.

Figure 3B:
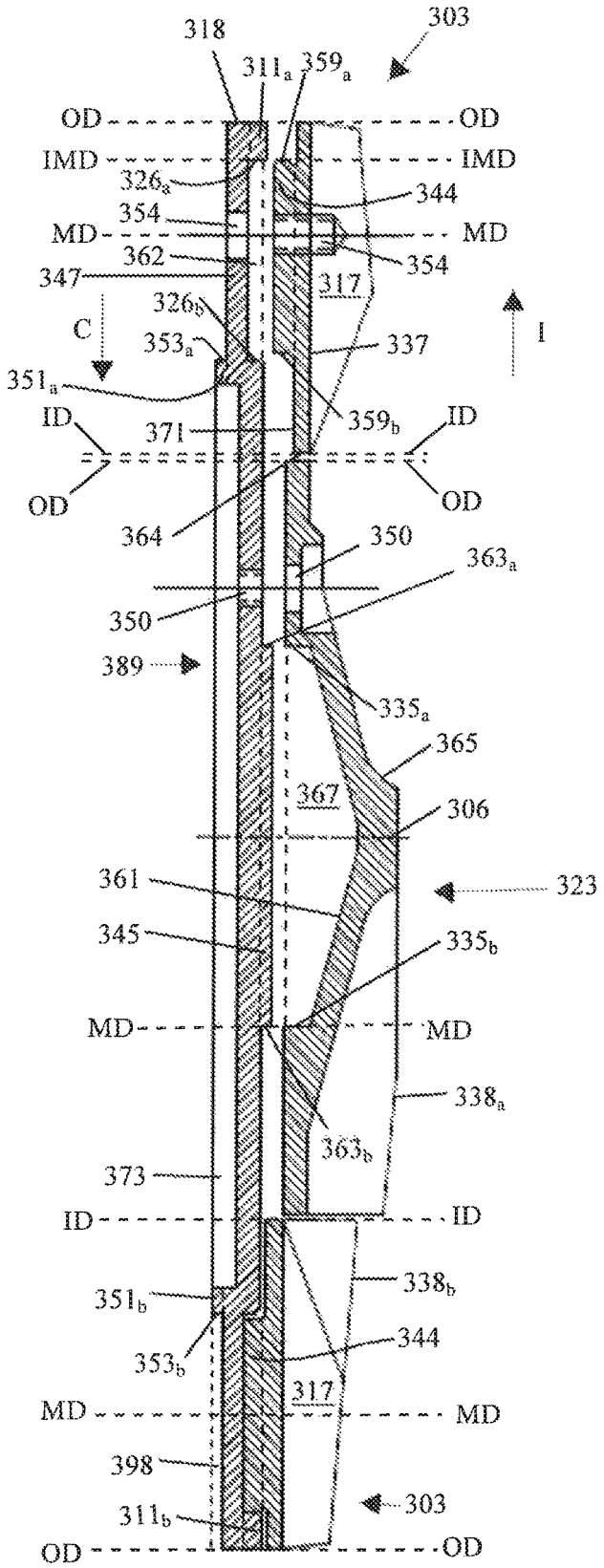
FIG. 3B is a cross-sectional side view of FIG. 3A, depicting the piloting arrangement for the rotor cap segments and center cap segment.

FIG. 3B shows that each rotor cap segment 317 may have a protrusion 344 extending from the back side 371 of the rotor cap segment 317. The protrusion 344 may be bounded by sidewalls $359_a$, $359_b$. A retaining lip 311 extends from the body 347 of the cap segment retainer 318 toward the front side 323 of the segmented rotor cap assembly 303. The retaining lip 311 can be disposed annularly around the cap segment retainer 318. It will be understood that the retaining lip 311 may be a single continuous element that is disposed around a diameter of the cap segment retainer 318. In other exemplary embodiments, multiple retaining lips 311 may be disposed around a common diameter on the cap segment retainer 318. In still other exemplary embodiments, the cap segment retainer 318 may have more than one retaining lip 311 disposed at different diameters on the cap segment retainer 318. In still other exemplary embodiments, the cap segment retainer 318 may have more than one retaining lip 311 disposed around at least one first common diameter and more than one retaining lips disposed around subsequent common diameters. Combinations of the above embodiments are considered to be within the scope of this disclosure.

For clarity, the use of the subscripts "a" or "b" after an element that may be configured to extend as a single piece around a diameter of a rotor 105, 605 rotor cap segment 317, 417, 517, 617, rotor cap segment retainer 318, central cap segment 365, or annular rotor cap segment retainer 527, 627 will be used to differentiate upper portions of the element from lower portions of the element.

The retaining lip $311_a$, has a sidewall $326_a$ configured to contact the sidewall $359_a$ of the protrusion 344. The retaining lip sidewall $326_a$ is disposed opposite a sidewall $326_b$ that extends from the body 347 of the cap segment retainer 318 toward the front side 323 of the segmented rotor cap assembly 303. The retaining lip sidewall $326_a$, the body 347 of the cap segment retainer 318 disposed between sidewall $326_a$ and $326_b$, and sidewall $326_b$ define a concave space 362 configured to receive the rotor cap's protrusion 344. The rotor cap protrusion 344 can be disposed between the sidewalls $326_a$ and $326_b$. In this manner, the sidewalls $326_a$, $326_b$ can define a space configured to receive the positioning means (e.g. the rotor cap's protrusion 344) and thereby position the rotor cap segments 317 relative to the central cap segment 365 or central cap portion 365' while providing structures configured to balance the forces the refiner plate segments 317 experience as a result of the rotor's circular motion. Fasteners 383 can engage the rotor cap segments 317 to the cap segment to the rotor 105 or a plate holder 113 through the cap segment retainer 318. In the depicted exemplary embodiment, the fasteners 383 extend from holes 354 in the rotor cap segments 317 through holes 354 in the cap segment retainer 318 but the fasteners 383 do not extend into the rotor 105 or plate holder 113. The fasteners that extend through threaded holes 350 sandwich the cap segment retainer 318 between the central cap segment 365 and the plate holder 113 and thereby hold the central cap segment 365 and the cap segment retainer 318 to the plate holder 113. In the depicted embodiment, the fasteners 383 extending through holes 354 merely engage the rotor cap segments 317 to the cap segment retainer 318. In this manner, the cap segment retainer 318 with retaining means may have threaded holes 350 configured to align with pre-existing holes in the rotor 105 (see 450, FIG. 4) while further providing additional holes 354 that do not align with pre-existing holes in the rotor 105. The fasteners 383 generally provide axial force (e.g. force parallel with the line representing the center of rotation 306) sufficient to secure the rotor cap segments 317 to the cap segment retainer 318 when the rotor 105 is not spinning. The fasteners 383 are not configured to withstand the inertia I the rotor cap segments 317 experience when the rotor 105 is spinning. In other exemplary embodiments, each hole on the cap segment retainer 318 may align with a pre-existing hole in the rotor 105. In still other exemplary embodiments involving threaded holes 350, additional fasteners 383 may extend through central cap segment 365, and secure the central cap segment 365 to the threaded holes 350 in the cap segment retainer 318. Alternatively, threaded holes 350 can be found in the central cap segment 365, lining up with holes in the plate holder 113, and fasteners 383 can extend through the central cap segment 365 and the cap segment retainer 318 to secure the central cap segment 365 to the plate holder 113 such that the cap segment retainer is sandwiched between the central cap segment 365 and the plate holder 113.

Figure 3C:
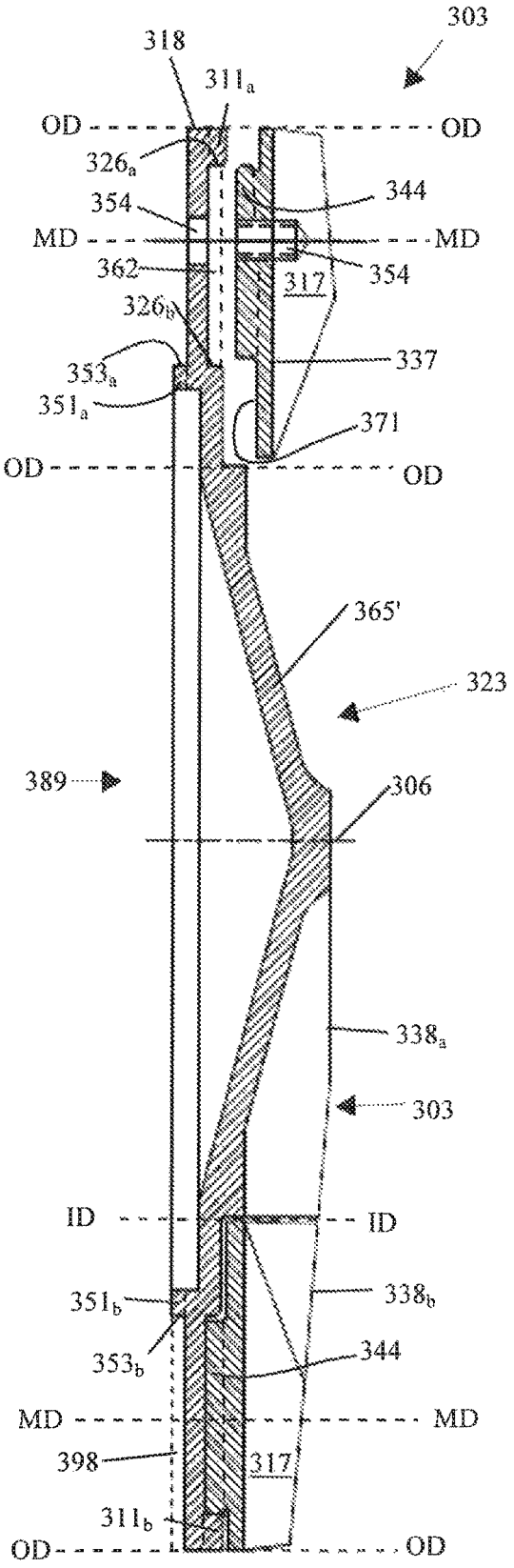
FIG. 3C is a cross-sectional side view of another exemplary segmented rotor cap assembly depicting the piloting arrangement for the rotor cap segments.

Without being bounded by theory, when the rotor 105 is spinning, the retaining lip $\mathbf{311}_a$ provides centripetal force C sufficient to cancel out the inertia I caused by the rotor's circular motion. In this example embodiment, retaining lip $\mathbf{311}_a$ is located near the outer diameter OD of the cap segment retainer 318 and is configured to pilot the rotor cap segment 317 at intermediate diameter IMD disposed between the rotor cap segment's outer diameter OD and the rotor cap segment's middle diameter MD. In FIGS. 3B and 3C, the outer diameter OD of the cap segment retainer 318 and rotor cap segment 317 are coextensive. In other exemplary embodiments, the outer diameter OD of the rotor cap segment 317 may not be coextensive with the outer diameter OD of the cap segment retainer 318. Retaining lip $\mathbf{311}_b$ preforms the same function at the bottom of the segmented rotor cap assembly 303. If the retaining lip $\mathbf{311}_a$ or similar means for nullifying the inertia I that the rotor cap segments 317 experience during rotational motion were absent, the rotor cap segments 317 may move radially outward beyond the outer diameter OD of the cap segment retainer 318. Such movement could unbalance the rotor 105, cause a rotor cap segment 317 to encroach into the refining gap 119, and generally accelerate the need for refiner maintenance or replacement.

It will be understood that although a segmented rotor cap 317 having one protrusion 344 is depicted in these figures, rotor caps 317 having multiple protrusions, including multiple protrusions of different dimensions, as well as corresponding positioning means are considered to be within the scope of this disclosure.

FIG. 3B further depicts a cross-sectional side view of an exemplary segmented rotor cap assembly 303 having a central cap segment 365 and rotor cap segments 317 disposed in a cap segment retainer 318. The central cap segment 365 and rotor cap segments 317 may be removable and replaceable after a desired time period, such as bi-annually to ensure suitable refiner performance and to preserve the integrity of fiber quality. Fasteners 383 generally engage the rotor cap segments 317 to the rotor 105 such that the cap segment retainer 318 is wedged between the rotor cap segments 317 and the rotor 105.

The cap segment retainer 318 may have a central protrusion 345 extending from the body 347 of the cap segment retainer 318. The central cap segment 365 has steps $\mathbf{335}_a$, $\mathbf{335}_b$ extending from the back side 361 of the central cap segment 365. The steps $\mathbf{335}_a$, $\mathbf{335}_b$, and the back side 361 of the central cap segment 365 define a concave space 367. In this exemplary embodiment, the steps $\mathbf{335}_a$, $\mathbf{335}_b$ are located substantially halfway between the center of rotation 306 and the retaining lip $\mathbf{311}_b$. The central protrusion 345 can be configured to extend into the concave space 365 such that the steps $\mathbf{335}_a$ and $\mathbf{335}_b$ contact the sidewalls $\mathbf{363}_a$, $\mathbf{363}_b$ of the central protrusion 345 and thereby position the central cap segment around the center of rotation 306 at the central cap segment's middle diameter MD.

Because the central cap segment 365 is a single piece, the continuous structure of the central cap segment 365 provides sufficient centripetal force C to nullify the inertia I caused by the rotor's circular motion around the center of rotation 306. The centripetal force C supplied by the central cap segment 365 and the positioning provided by the steps $\mathbf{335}_a$ and $\mathbf{335}_b$ and central protrusion 345 of the cap segment retainer 318 pilot the central cap segment 365 around the center of rotation 306 at the central cap segment's middle diameter MD. Other piloting means may be used to pilot the central cap segment 365. In other exemplary embodiments the central cap segment 365 may be piloted at the cap segment retainer's intermediate diameter (IMD), a cap segment retainer's outer diameter (OD), or a combination thereof. The cap segment retainer 318 may be forged and machined to precise specifications. In other exemplary embodiments, the cap segment retainer may be cast and machined. In the example embodiments of FIGS. 3B and 3C, the cap segment retainer 318 further comprises positioning steps $\mathbf{351}_a$, $\mathbf{351}_b$ that extend from the back side 389 of the cap segment retainer 318. The positioning steps $\mathbf{351}_a$, $\mathbf{351}_b$, and the body 347 of the cap segment retainer 318 define a second concave space 373 configured to receive a center rotor protrusion (not depicted). Each positioning step $\mathbf{351}_a$, $\mathbf{351}_b$ has an outer wall $\mathbf{353}_a$, $\mathbf{353}_b$ respectively. Referring to positioning step $\mathbf{351}_b$ in particular, the outer wall $\mathbf{353}_b$ of the positioning step $\mathbf{351}_b$ engages the sidewall 396 of a pre-existing annular protrusion 398 on the rotor 105. The pre-existing annular protrusion 398 and the positioning step $\mathbf{351}_b$ position the cap segment retainer 318 on the rotor 105. The pre-existing annular protrusion 398 provides centripetal force C that is equal and opposite to the force of inertia I that the cap segment retainer 318 experiences as a result of the rotor's circular motion. In this manner the positioning step $\mathbf{351}_b$ and the pre-existing annular protrusion 398 pilot the cap segment retainer 318 on the rotor 103 using the outer wall $\mathbf{353}_b$ of the positioning step $\mathbf{351}_b$. In this exemplary embodiment, positioning step $\mathbf{351}_a$ pilots the cap segment retainer 318 in substantially the same manner. It will be understood that on other exemplary embodiments, the cap segment retainer 318 may be piloted with the inner walls of positioning steps $\mathbf{351}_a$, $\mathbf{351}_b$. It will further be understood that in other exemplary embodiments, the rotor cap segments may be piloted by the outer walls or inner walls of interlocking elements.

FIG. 3C depicts a cross-sectional side view of an exemplary segmented rotor cap assembly 303 in which the center portion 365', bounded by the inner diameter ID of the rotor cap segments 317, is an integral element in the cap segment retainer 318. In this exemplary embodiment, the cap segment retainer 318 is positioned on the rotor 105 around the center of rotation 306 in the same manner as the embodiment in FIG. 3B.

Although retaining lip 311 and rotor cap protrusion 344 pilot the rotor cap segments 317 in FIGS. 3A-3C, it will be understood that any of the piloting means disclosed in this application may be used singularly or in combination with other piloting means to pilot the rotor cap segments 317 and cap segment retainer 318 consistent with the manner disclosed herein.

Figure 4:
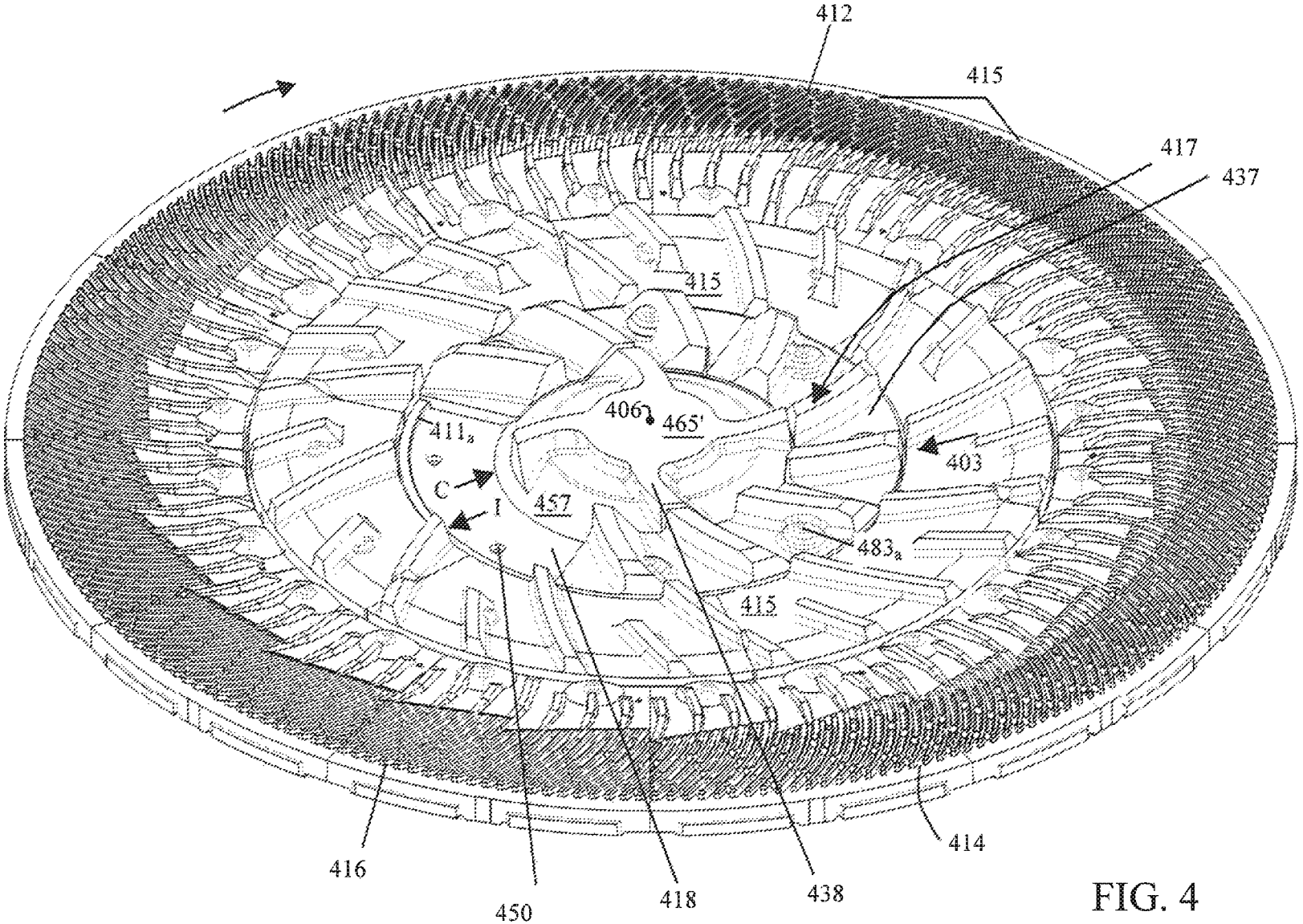
FIG. 4 is a perspective view of an exemplary segmented rotor cap disposed on a rotor disc with refiner plates.

FIG. 4 is a perspective view facing an exemplary segmented rotor cap assembly 403 surrounded by refiner plate segments 415. In this figure, fasteners 483 engage both the segmented rotor cap assembly 403 and the refiner plate segments 415 to a rotor (see 105). In this particular embodiment, the refiner plate segments 415 have a series of alternating bars 416 and grooves 414. Dams 412 may bridge two or more bars 416 thereby separating grooves in a generally radial direction (e.g. a direction originating at the center of rotation 406 and moving outward toward the outer diameter OD of the rotor 105). Dams 412 force lignocellulosic feed material F into the refining gap 119 and facilitate refining. It will be understood that although FIG. 4 depicts a refiner, the segmented rotor cap assembly 406 may be configured to be used with dispersers or other devices configured to separate, develop, and cut fibers in lignocellulosic material with plates having abrasive surfaces, which may include intermeshing teeth designs.

In the exemplary embodiment depicted in FIG. 4, the segmented rotor cap assembly 403 comprises a set of rotor cap segments 417. The rotor cap segments 417 are removable and may be replaced after a desired time period. The embodiment in FIG. 4 has a rotor cap segment retainer 418 with an integrated central portion 465'. Fasteners $\mathbf{483}_a$ can engage the cap segment retainer 418 to the rotor 105 using the original holes 450 in the rotor 105. The cap segment retainer 418 provides through holes 450 that align with the original holes of the rotor 105. The exemplary cap segment retainer 418 includes a first retaining lip $\mathbf{411}_a$ configured to apply centripetal force C to the rotor cap segments 417 at an intermediate diameter IMD (see FIG. 3B) near the rotor cap segment's outer diameter OD (See FIG. 3B).

Figure 5A:
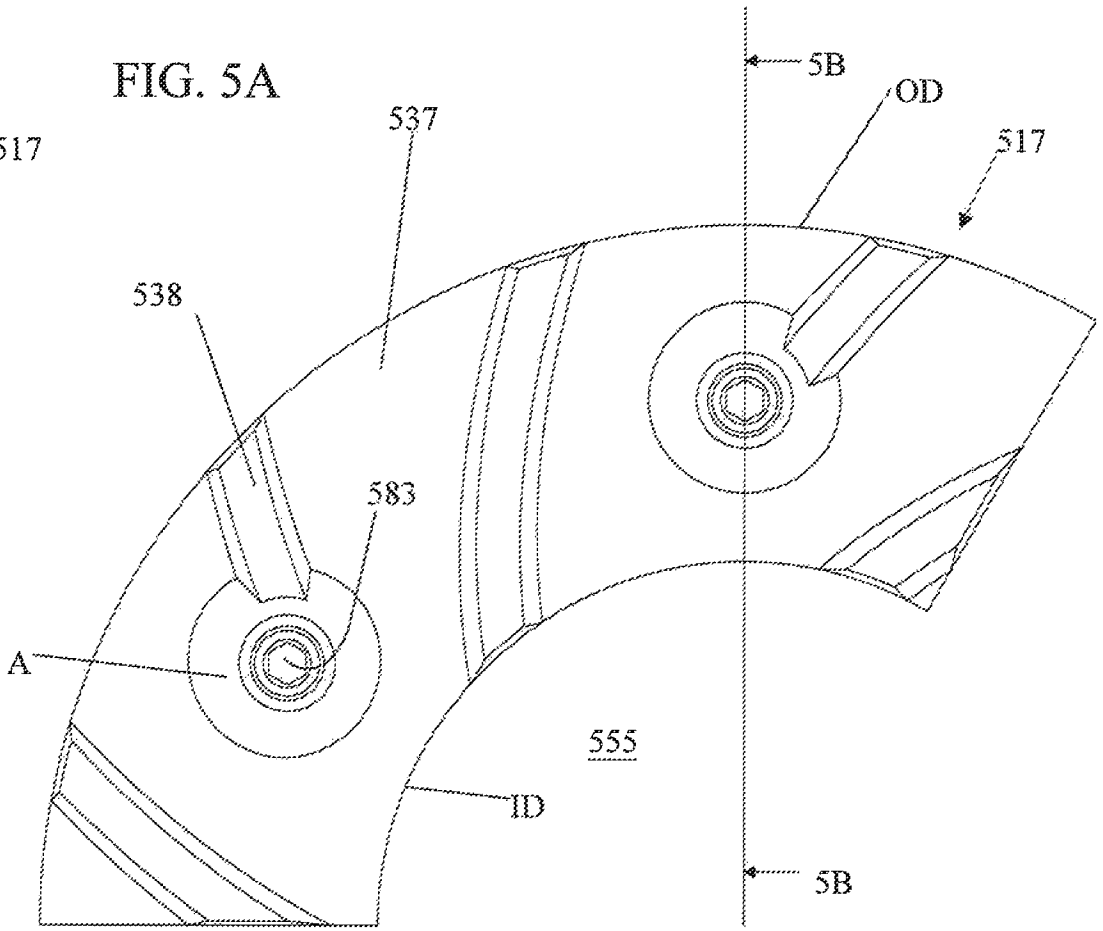
FIG. 5A if a facing view of rotor cap segment configured to be piloted with an annular cap segment retainer.
Figure 5B:
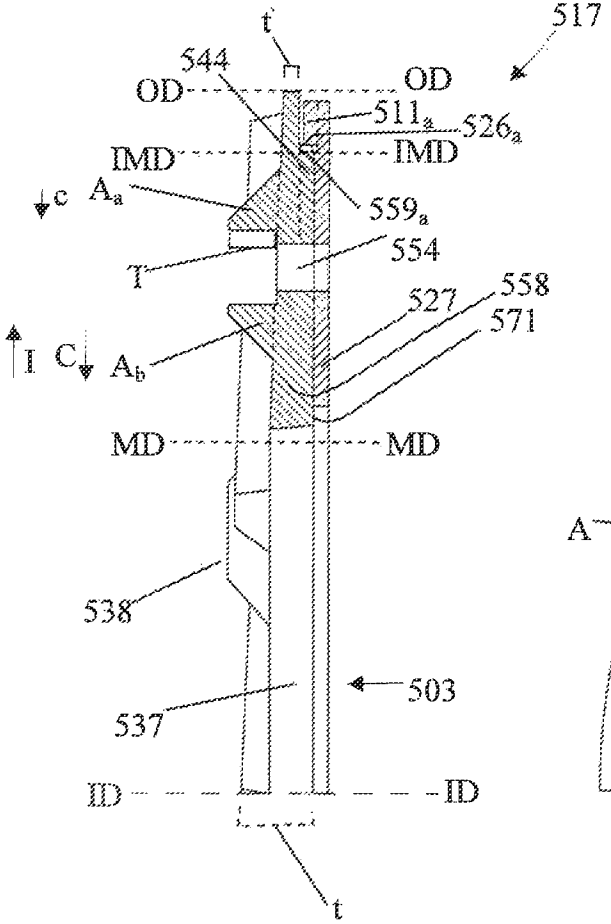
FIG. 5B is a cross sectional side view of the rotor cap segment in FIG. 5A along the line 5B-5B further depicting the annular cap segment retainer.
Figure 6A:
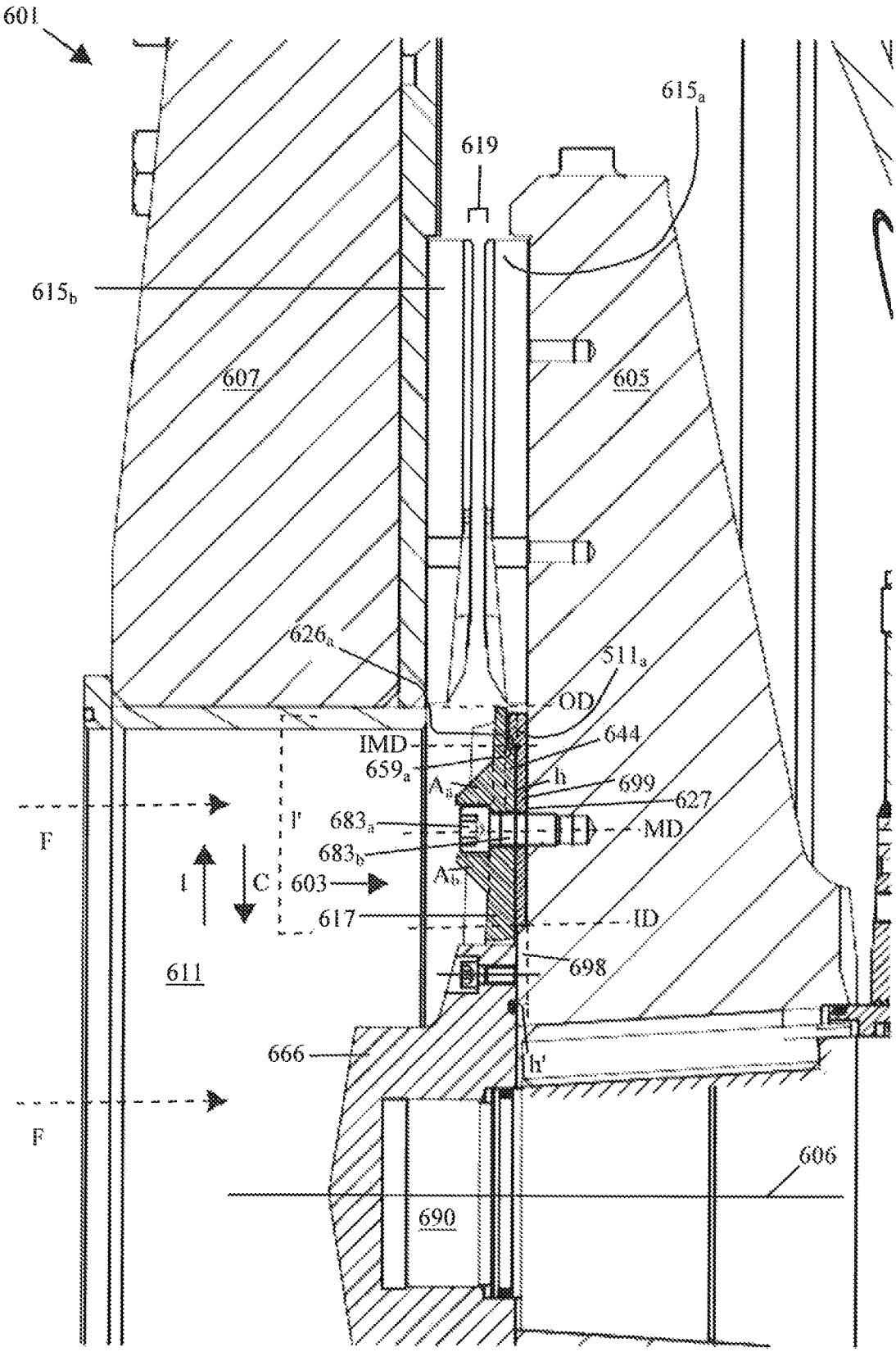
FIG. 6A. is a cross-sectional side view of an exemplary rotor cap segment and annular cap segment retainer mounted around a rotor central part.
Figure 6B:
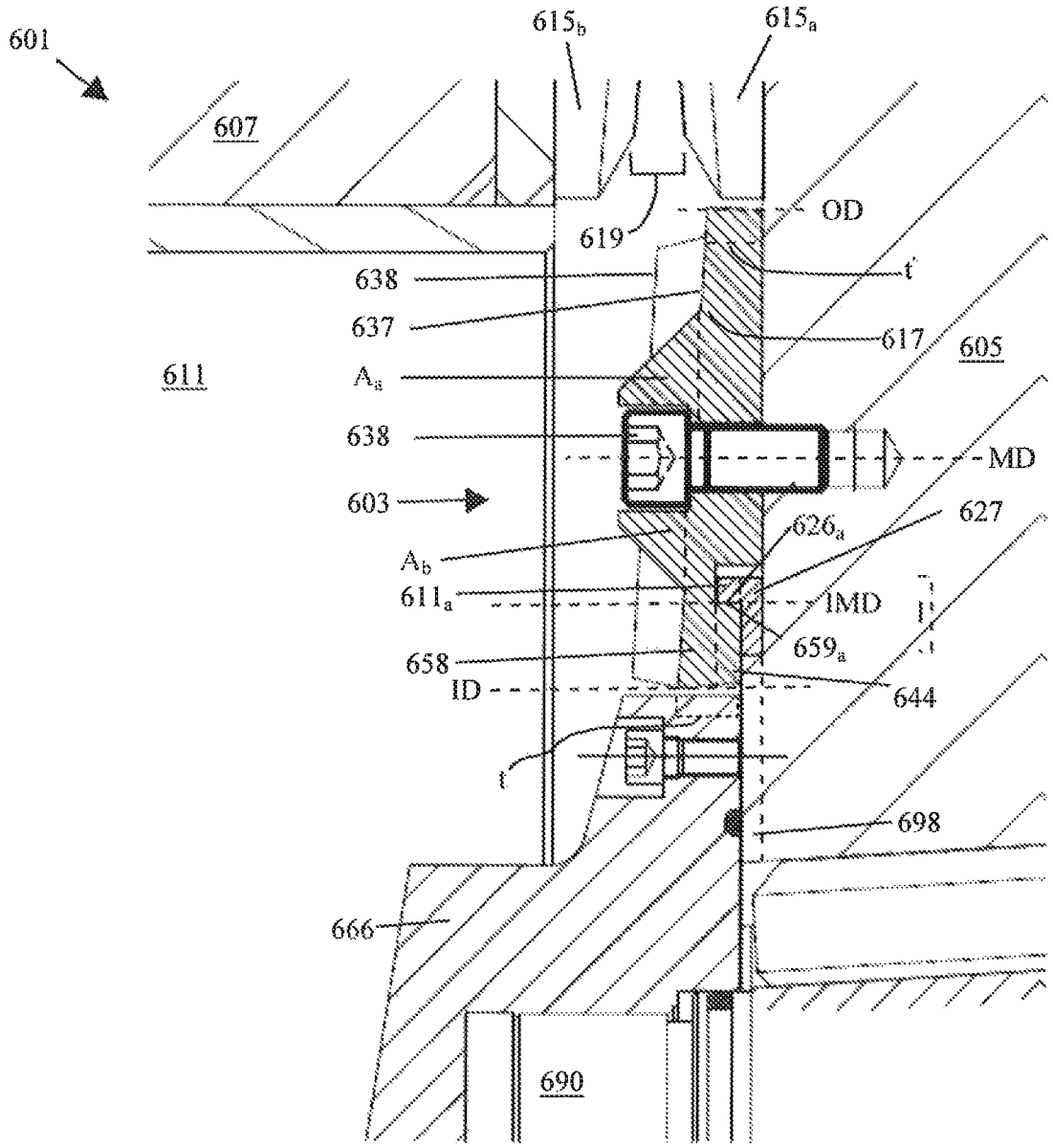
FIG. 6B. is cross-sectional side view of another exemplary segmented rotor cap segment and annular cap segment retainer mounted around a rotor central part.

FIG. 5A depicts a single rotor cap segment 517 configured to be piloted around a central part 666 (FIG. 6A, 6B) of a rotor 605 (FIG. 6A, 6B) with an annular cap segment retainer 527 (FIG. 5B). The rotor cap segment 517 has wide bars 538 and wide channels 537 configured to fling lignocellulosic feed material F into the refining gap 619 (FIG. 6A, 6B). The rotor cap segment 517 may further have an area A around the fasteners 583 that has a thickness T (FIG. 5B) that is thicker than a thickness t (FIG. 5B) of the body 558 of the rotor cap segment 517. The area A around the fasteners 583 may protect the sides of the fasteners 583 from incoming lignocellulosic feed material F and thereby reduce fastener wear.

FIG. 5B is a cross sectional side view of the embodiment in FIG. 5A taken along the line 5B-5B. The annular cap segment retainer 527 and rotor cap segment 517 define a hole 550 configured to receive a fastener 583. Although the fasteners 583 are not configured to pilot the rotor cap segments 517, the head $\mathbf{683}_a$ (FIG. 6A) of the fastener 583 provides weak centripetal force c to the lower portion of the area $A_b$ around the fasteners 583. This weak centripetal force c is insufficient to cancel out the inertia I of the rotor cap segment 517 and therefore, the fasteners 583 do not pilot the rotor cap segments 517. In certain exemplary embodiments, the thickness t of the rotor cap segment 517 at a rotor cap segment's inner diameter ID may exceed the thickness t' of the rotor cap segment 517 at the rotor cap segment's outer diameter OD. The thickness t of the body 558 of the rotor cap segment 517 may decrease gradually and continuously along the body 558 from the inner diameter ID to the outer diameter OD.

The annular cap segment retainer 527 is a single-piece rotor cap segment piloting plate. The annular cap segment retainer 527 may be configured to pilot the rotor cap segments 517 at a rotor cap segment's outer diameter OD. In other exemplary embodiments, the annular cap segment retainer 527 can be configured to pilot the rotor cap segments 517 at an intermediate diameter IMD disposed between the rotor cap segment's inner diameter ID and the rotor cap segment's outer diameter OD. In still other exemplary embodiments the annular cap segment retainer 527 can be configured to pilot the rotor cap segments 517 at a rotor cap segment's middle diameter MD.

In the exemplary embodiment of FIG. 5B, the annular cap segment retainer 527 has a retaining lip $\mathbf{511}_a$ with a sidewall $\mathbf{526}_a$ configured to engage the sidewall $\mathbf{559}_a$ of rotor cap protrusion 544. In this exemplary embodiment, the protrusion 544 extends from the body 558 of the rotor cap segment 517 at the back side 571 of the rotor cap segment 517. The piloting lip $\mathbf{511}_a$ provides centripetal force C sufficient to nullify the inertia I the rotor cap segment 517 experiences as a result of the rotor's circular motion, and thereby pilots the rotor cap segment 517 near the outer diameter OD.

Figure 5C:
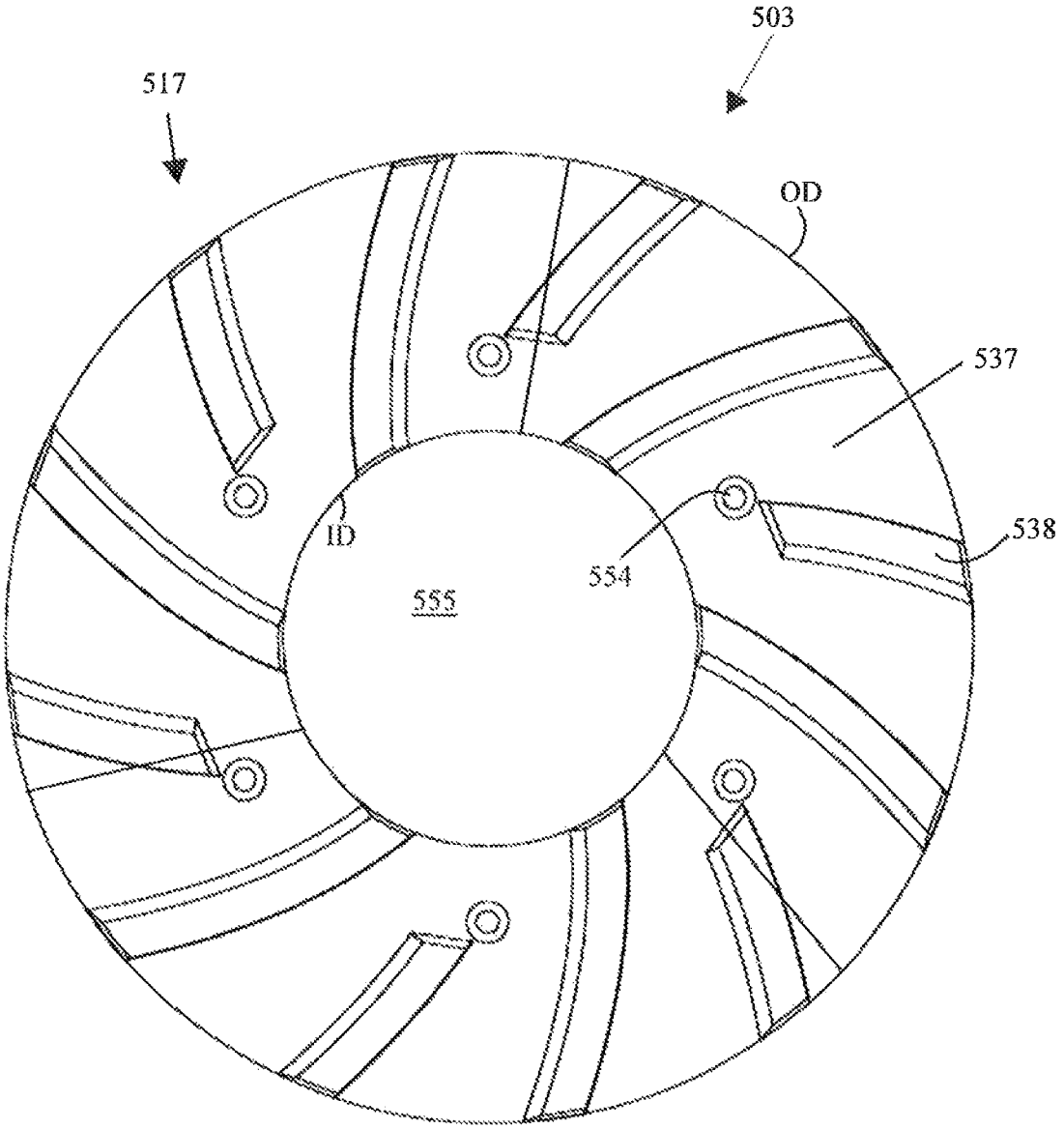
FIG. 5C is a facing view of an exemplary segmented annular rotor cap.

FIG. 5C is a front view of three rotor cap segments 517 configured to be used with an annular cap segment retainer 527. The amount of rotor cap segments 517 in an exemplary segmented rotor cap assembly 503 is desirably three or more. In FIG. 5C, the segmented rotor cap assembly 503 has an area defining a center hole 555 in the center of the annular segmented rotor cap assembly 503.

FIG. 6A is a cross sectional side view of a refiner 601 outfitted with an exemplary segmented rotor cap assembly 603 piloted at an intermediate diameter IMD between the rotor cap segment's outer diameter OD and the rotor cap segment's middle diameter MD. An annular cap segment retainer 627 has a retaining lip $\mathbf{511}_a$ that pilots the rotor cap segments 517 in the same manner described in FIG. 5B.

The annular rotor cap assembly 503 may be disposed around a central part 666. The central part 666 may be conical to facilitate directing lignocellulosic feed material F from the feed inlet 611 toward the rotor cap segments 617 and ultimately the refining gap 619 defined by the opposing refiner plate segments $\mathbf{615}_a$ disposed on the rotor 605, $\mathbf{615}_b$ disposed on the stator 607.

In this exemplary embodiment, the rotor 605 has a pre-existing annular protrusion 698. The annular cap segment retainer 627 is a single piece that has an inner diameter ID and an outer diameter OD. The body 699 of the annular cap segment retainer 627 has a height h that may equal the height h' of the pre-existing annular protrusion 698. The pre-existing annular protrusion 698 can position the annular cap segment retainer 627 around the center of rotation 606. Because the annular cap segment retainer 627 is a single-annular piece, the structural integrity of the annular cap segment retainer 627 provides the centripetal force sufficient to cancel out the inertia I caused by the rotor's circular motion. In this manner, the pre-existing annular protrusion 698 and the annular cap segment retainer 627 pilot the annular cap segment retainer 627 at the cap segment retainer's inner diameter ID.

FIG. 6B is a cross sectional view of another exemplary segmented rotor cap assembly 603 with an annular rotor cap retainer 627. The annular cap segment retainer 627 pilots the rotor cap segment 617 at an intermediate diameter IMD between the rotor cap segment's middle diameter MD and the rotor cap segment's inner diameter ID. The annular cap segment retainer 627 may have a length l that is generally shorter than a length l' (FIG. 6A) of an annular cap segment retainer 627 configured to pilot a rotor cap segment at the rotor cap's outer diameter OD or at an intermediate diameter IMD between the rotor cap's outer diameter OD the rotor cap's middle diameter MD. Rotor caps segments may have a thickness t near the center of rotation 606 that is thicker than a rotor cap's thickness t' at the outer diameter OD of the rotor cap segments. A rotor cap segment 617 may be thinner at the outer diameter OD to avoid blocking the refining gap 619. Piloting the rotor cap segments 617 at an intermediate diameter IMD between the rotor cap segments' middle diameter MD and the rotor cap segments' inner diameter ID may allow operators to use rotor cap segments where there is limited clearance between the rotor 605 and the refining gap 619.

While this invention has been particularly shown and described with references to example embodiments thereof, it will be understood by those skilled in the art that various changes in form and details may be made therein without departing from the scope of the invention encompassed by the appended claims.

What is claimed is:

1. A rotor cap assembly comprising:

multiple rotor cap segments configured to be disposed radially inward of refiner plate segments of a refiner, each rotor cap segment having a front side, a back side, a rotor cap segment inner diameter, a rotor cap segment outer diameter, and positioning means on the back side of each rotor cap segment; and a cap segment retainer configured to be engaged to a rotor through pre-existing fixing holes in the rotor, the cap segment retainer having a back side and retaining means on a front side of the cap segment retainer, wherein the multiple rotor cap segments are disposed on the front side of the cap segment retainer, and wherein the retaining means engage the positioning means on the back side of each rotor cap segment such that the retaining means and the positioning means pilot the multiple rotor cap segments at a rotor cap segment diameter.

2. The rotor cap assembly of claim 1, wherein the cap segment retainer further comprises holes aligning with pre-existing holes on the rotor and fasteners extending through the cap segment retainer and through pre-existing holes in the rotor to engage the cap segment retainer to the rotor.

3. The rotor cap assembly of claim 1, wherein the cap segment retainer further comprises holes aligning with holes in a plate holder disposed between the cap segment retainer and the rotor, wherein fasteners extend through the cap segment retainer and into the plate holder.

4. The rotor cap assembly of claim 1, wherein the retaining means and the positioning means pilot the multiple rotor cap segments at the outer diameter of the multiple rotor cap segments.

5. The rotor cap assembly of claim 1, wherein a rotor cap segment of the multiple rotor cap segments further comprises a middle diameter halfway between the rotor cap segment inner diameter and the rotor cap segment outer diameter and wherein the retaining means and the positioning means pilot the rotor cap segment at an intermediate diameter between the middle diameter and the outer diameter.

6. The rotor cap assembly of claim 1, wherein a rotor cap segment of the multiple rotor cap segments further comprises a middle diameter halfway between the rotor cap segment inner diameter and the rotor cap segment outer diameter and wherein the retaining means and the positioning means pilot the rotor cap segment at an intermediate diameter between the middle diameter and the inner diameter.

7. The rotor cap assembly of claim 1, wherein the cap segment retainer is an annular cap segment retainer.

8. A rotor cap assembly comprising:

multiple rotor cap segments configured to be disposed radially inward of refiner plate segments of a refiner, each rotor cap segment having:

a front side, a back side, a rotor cap segment inner diameter, a rotor cap segment outer diameter, a rotor cap segment middle diameter located between the rotor cap inner diameter and the rotor cap outer diameter, and a protrusion extending from the back side, wherein the protrusion has a protrusion sidewall at a side of the protrusion; and a cap segment retainer configured to be engaged to a rotor through pre-existing holes in the rotor, the cap segment retainer having:

a back side, a front side, a body, and a retaining lip extending from the front side of the cap segment retainer, wherein the retaining lip has a retaining lip sidewall at a side of the retaining lip, wherein a top of the retaining lip sidewall and the body of the cap segment retainer define a concave space, and wherein the protrusion is disposed within the concave space such that the protrusion sidewall contacts the retaining lip sidewall.

9. The rotor cap assembly of claim 8, wherein the cap segment retainer further comprises holes aligning with the pre-existing holes on the rotor and fasteners extending through the cap segment retainer and through pre-existing holes in the rotor to engage the cap segment retainer to the rotor.

10. The rotor cap assembly of claim 8, wherein the cap segment retainer further comprises holes aligning with holes in a plate holder disposed between the cap segment retainer and the rotor, wherein fasteners extend through the cap segment retainer and into the plate holder.

11. The rotor cap assembly of claim 8, wherein the retaining lip sidewall contacts the protrusion sidewall to pilot a rotor cap segment of the multiple rotor cap segments at the rotor cap segment outer diameter.

12. The rotor cap assembly of claim 8, wherein the retaining lip sidewall contacts the protrusion sidewall to pilot a rotor cap segment of the multiple rotor cap segments at an intermediate diameter between the rotor cap segment outer diameter and the rotor cap segment middle diameter.

13. The rotor cap assembly of claim 8, wherein the retaining lip sidewall contacts the protrusion sidewall to pilot a rotor cap segment of the multiple rotor cap segments at an intermediate diameter between the rotor cap segment inner diameter and the rotor cap segment middle diameter.

14. The rotor cap assembly of claim 8 further comprising a central cap segment configured to be piloted on the cap segment retainer.

15. The rotor cap assembly of claim 8, wherein the cap segment retainer is an annular cap segment retainer.

16. The rotor cap assembly of claim 15, wherein the retaining lip sidewall contacts the protrusion sidewall to pilot a rotor cap segment of the multiple rotor cap segments at an intermediate diameter between the rotor cap segment outer diameter and the rotor cap segment middle diameter.

17. The rotor cap assembly of claim 16 further comprising a central cap segment having center of rotation, an outer diameter, and a central cap segment interlocking element is configured to engage a retainer interlocking element at a central cap diameter radially distal from the center of rotation.

18. The rotor cap assembly of claim 15, wherein the retaining lip sidewall contacts the protrusion sidewall to pilot a rotor cap segment of the multiple rotor cap segments at an intermediate diameter between the rotor cap segment inner diameter and the rotor cap segment middle diameter.

19. An annular rotor cap assembly comprising:

multiple rotor cap segments configured to be disposed radially inward of refiner plate segments of a refiner, each rotor cap segment having a front side, a back side, a rotor cap segment inner diameter, a rotor cap segment outer diameter, and a cap segment interlocking element; and a cap segment retainer engaging a rotor through pre-existing holes in the rotor, the cap segment retainer having a back side, a front side, and a retainer interlocking element, wherein the cap segment interlocking element engages the retainer interlocking element at a rotor cap segment diameter radially distal from the rotor cap segment inner diameter.

20. The rotor cap assembly of claim 19, wherein the cap segment retainer further comprises holes aligning with the pre-existing holes on the rotor and fasteners extending through the cap segment retainer and through pre-existing holes in the rotor to engage the cap segment retainer to the rotor.

21. The rotor cap assembly of claim 19, wherein the cap segment retainer further comprises holes aligning with holes in a plate holder disposed between the cap segment retainer and the rotor, wherein fasteners extend through the cap segment retainer and into the plate holder.

22. The rotor cap assembly of claim 19, wherein the cap segment interlocking element and the retainer interlocking element define an interlocking mechanism and wherein the interlocking mechanism pilots a rotor cap segment of the multiple rotor cap segments at an intermediate diameter between the rotor cap inner diameter and the rotor cap outer diameter.

23. The rotor cap assembly of claim 19, wherein the cap segment retainer is an annular cap segment retainer.

24. The rotor cap assembly of claim 19 further comprising fasteners configured to engage the multiple rotor cap segments and the cap segment retainer to a rotor.

* * * * *